US005870996A

United States Patent [19]

DeLuca

[11] Patent Number: 5,870,996

[45] Date of Patent: Feb. 16, 1999

[54] HIGH-PRESSURE DUAL-FEED-RATE INJECTOR PUMP WITH AUXILIARY SPILL PORT

[75] Inventor: Frank DeLuca, Enfield, Conn.

[73] Assignee: Alfred J. Buescher, Shaker Heights, Ohio

[21] Appl. No.: 58,339

[22] Filed: Apr. 10, 1998

[51] Int. Cl.[6] ..... F02M 37/04; F02M 41/08

[52] U.S. Cl. ..... 123/496; 123/300

[58] Field of Search ..... 123/506, 496, 123/300, 299, 500, 501

[56] References Cited

U.S. PATENT DOCUMENTS

| | | | |
|---|---|---|---|
| 1,981,913 | 11/1934 | Fielden . | |
| 2,513,883 | 7/1950 | Male . | |
| 2,547,174 | 4/1951 | Rogers . | |
| 2,551,053 | 5/1951 | Rogers . | |
| 2,890,657 | 6/1959 | May et al. . | |
| 3,006,556 | 10/1961 | Shade et al. . | |
| 3,115,304 | 12/1963 | Humphries . | |
| 3,216,359 | 11/1965 | Teichert . | |
| 3,267,863 | 8/1966 | Clifton . | |
| 3,481,542 | 12/1969 | Huber . | |
| 3,566,849 | 3/1971 | Frick . | |
| 3,567,346 | 3/1971 | Mekkes et al. . | |
| 3,827,832 | 8/1974 | Faupel et al. . | |
| 3,837,324 | 9/1974 | Links . | |
| 3,880,131 | 4/1975 | Twaddell et al. . | |
| 3,942,914 | 3/1976 | Hofer et al. . | |
| 4,073,275 | 2/1978 | Hofer et al. . | |
| 4,129,253 | 12/1978 | Bader, Jr. et al. . | |
| 4,165,723 | 8/1979 | Straubel . | |
| 4,211,203 | 7/1980 | Kobayashi | 123/496 |
| 4,229,148 | 10/1980 | Richmond . | |
| 4,351,283 | 9/1982 | Ament . | |
| 4,367,706 | 1/1983 | Seheying | 123/300 |
| 4,389,987 | 6/1983 | Frankle . | |
| 4,392,612 | 7/1983 | Deckard et al. . | |
| 4,470,545 | 9/1984 | Deckard et al. . | |
| 4,527,737 | 7/1985 | Deckard . | |
| 4,572,433 | 2/1986 | Deckard . | |
| 4,709,679 | 12/1987 | Djordjevic et al. . | |
| 4,741,314 | 5/1988 | Hofer . | |
| 4,757,794 | 7/1988 | Hofer . | |
| 4,763,631 | 8/1988 | Fehlmann | 123/496 |
| 4,870,936 | 10/1989 | Eheim . | |
| 4,881,506 | 11/1989 | Hoecker . | |
| 4,940,037 | 7/1990 | Eckert . | |
| 4,951,874 | 8/1990 | Ohnishi et al. . | |
| 4,975,029 | 12/1990 | Hatz | 123/300 |
| 5,020,979 | 6/1991 | Askew | 123/300 |
| 5,029,568 | 7/1991 | Perr . | |
| 5,390,851 | 2/1995 | Long et al. . | |
| 5,566,660 | 10/1996 | Camplin | 123/496 |
| 5,592,915 | 1/1997 | Ishiwata | 123/496 |

FOREIGN PATENT DOCUMENTS

| | | | |
|---|---|---|---|
| 0045654 | 2/1990 | Japan | 123/496 |
| 0045654 | 9/1990 | Japan . | |
| 1375848 | 2/1988 | U.S.S.R. . | |

*Primary Examiner*—Carl S. Miller

*Attorney, Agent, or Firm*—Pearne, Gordon, McCoy & Granger LLp

[57] ABSTRACT

A diesel fuel injector is provided with a secondary spill aperture operable to increase to a maximum value and then decrease to zero during an early part of the injection portion of the stroke of the injector pump plunger in a manner to maintain injection pressure at relatively high levels at the beginning of such injection portion of the plunger stroke whereas the rate of injection is lower during such early part of such injection portion than it would be in the absence of said secondary spill aperture.

9 Claims, 9 Drawing Sheets

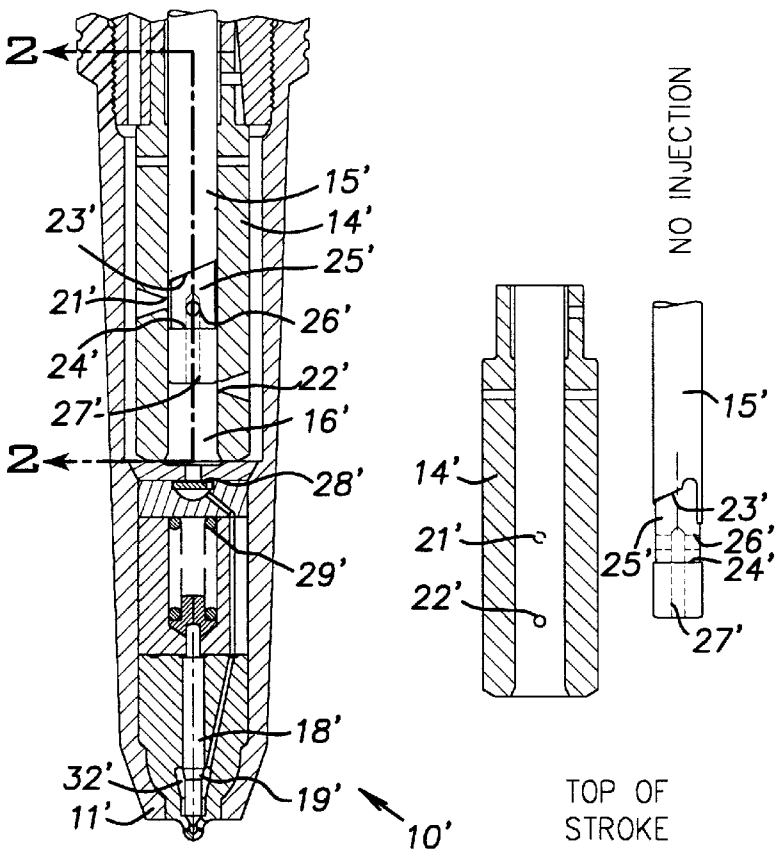
FIG. 1 (PRIOR ART)
FIG. 2 (PRIOR ART)
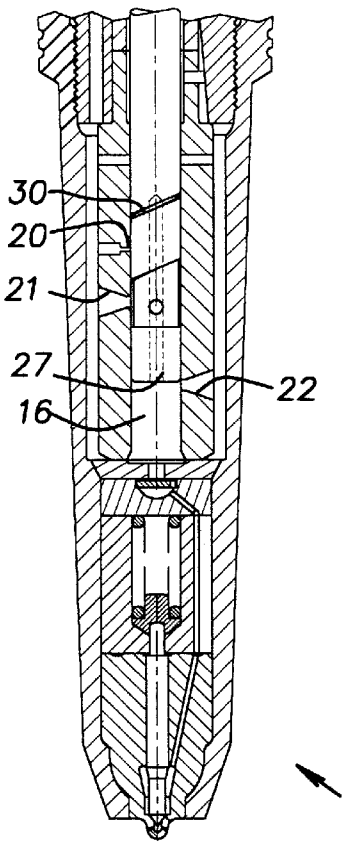
FIG. 3
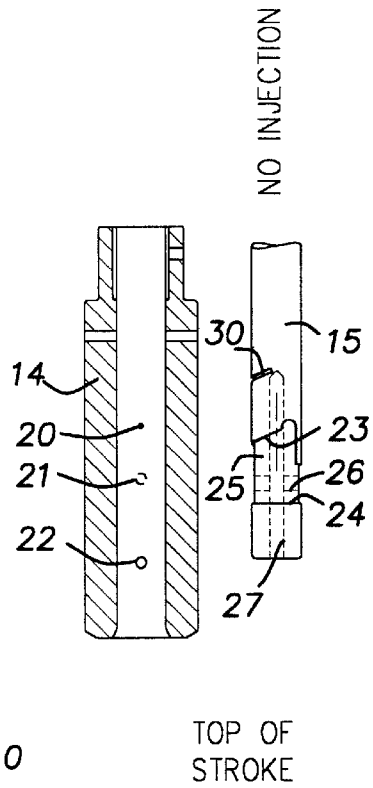
FIG. 4

FULL LOAD
15
30
23
20
21
22
BOTTOM OF STROKE

FULL LOAD
15
30
23
EFFECTIVE STROKE
END OF INJECTION
20
21
22

FULL LOAD
MID LOAD
IDLING LOAD
NO INJECTION
30
23
24
27
30
31
EFFECTIVE STROKES
START OF INJECTION
27
30
31
20
21
22

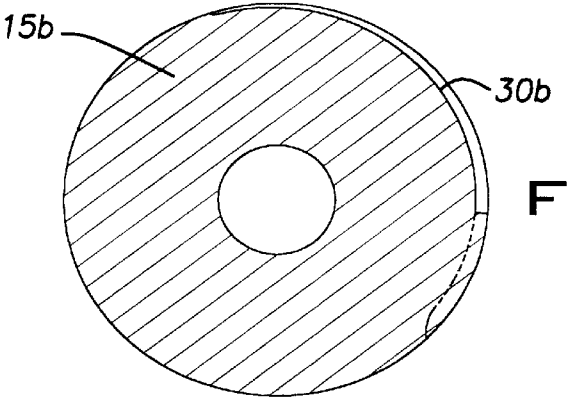
FIG. 6B
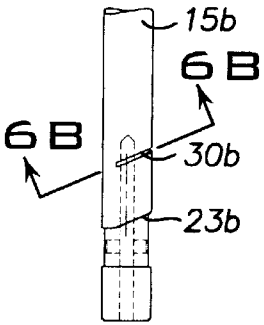
FIG. 6A
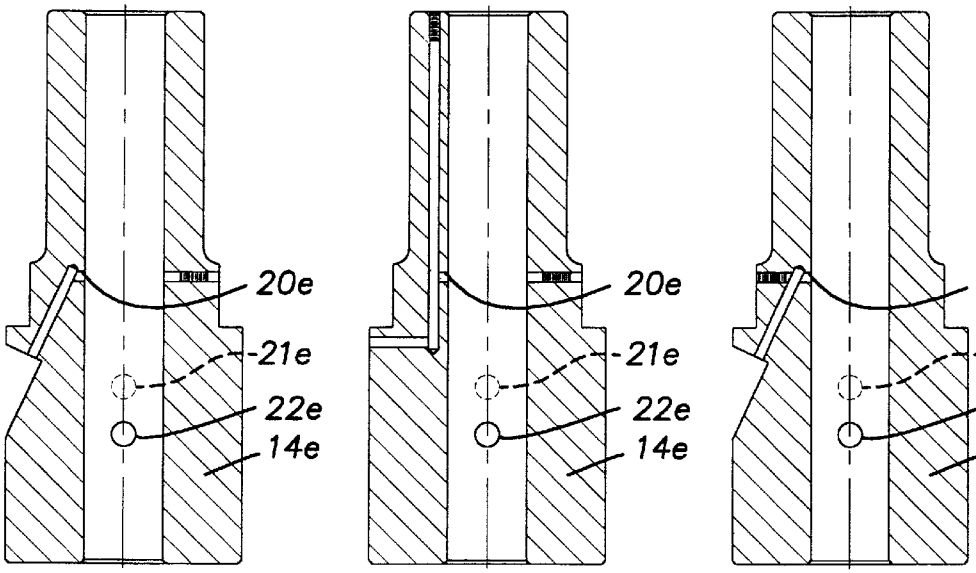
FIG. 17
FIG. 18
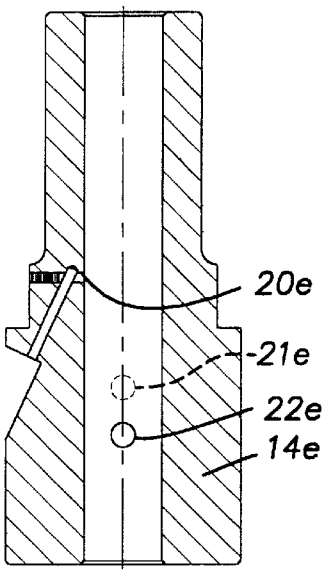
FIG. 19

FIG. 22
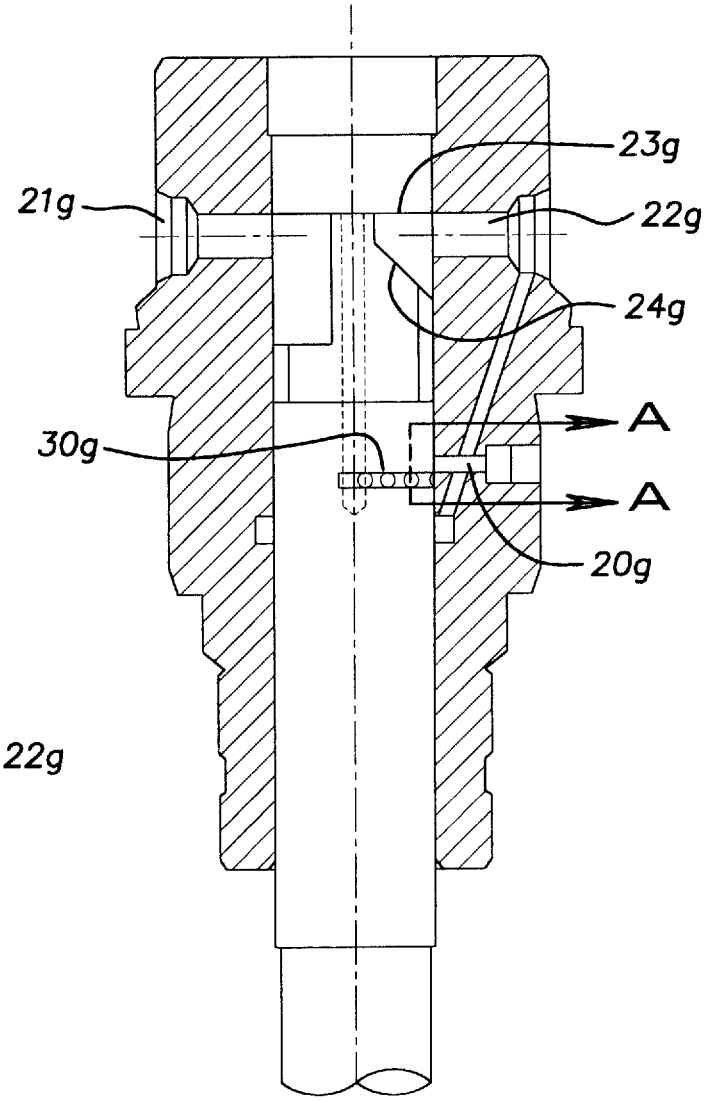
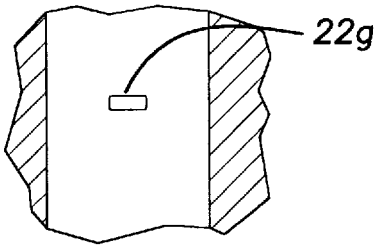
FIG. 22A

HIGH-PRESSURE DUAL-FEED-RATE INJECTOR PUMP WITH AUXILIARY SPILL PORT

FIELD OF THE INVENTION

This invention relates to diesel fuel injectors and fuel injection pumps of the mechanical spill type (in which spill valving is controlled by mechanical linkages driven by the engine), as distinguished from the solenoid spill type (in which spill valving is controlled by solenoid actuators). The invention is applicable to systems in which one fuel metering element or pump is used for each cylinder of the engine. Thus the invention is applicable to unit injectors used on locomotive and automotive engines, in which the pump, nozzle and holder assembly are a single unit. The invention is also applicable to injection systems in which the fuel is fed from the pump through tubing to a separate nozzle and holder assembly uniquely associated with that pump.

BACKGROUND OF THE INVENTION

Reference is made to my co-pending application entitled HIGH-PRESSURE DUAL-FEED-RATE INJECTOR PUMP WITH GROOVED PORT-CLOSING EDGE, filed on the same day as the present application and directed to related subject matter. The disclosure of such co-pending application is incorporated by reference in this application as if fully repeated herein.

Some fuel injector pumps of the mechanical spill type rely on a sleeve separate from the bushing and slidable on or relative to the pump plunger to contribute to the valving of fuel, in order for example to combine spill valving with the sequential distribution of fuel from a single pump to two or more injection nozzles at two or more separate cylinders of a diesel engine. In such "sleeved" assemblies, there is one pattern of relative motion between the pump plunger and the bushing and an altered pattern of relative motion between the plunger and the sleeve.

However the type of plunger and bushing pumps to which the invention relates are of a another sub-type which may be referred to as "sleeveless" in that no sleeves are used for spill valving; rather the pump's own spill valving functions (as distinguished from the valving functions of a check valve or an injection valve associated with the pump) are entirely accomplished by interactions between (1) edges and cut-outs formed on the pump plunger and (2) orifices opening into the pump bore from the low pressure passages. Such sleeveless pumps or plunger and bushing devices are typically associated with the use of one pump for each cylinder of the engine.

Fuel injectors of the sleeveless mechanical spill type include a fuel pump and an injection nozzle associated with the fuel pump. The fuel pump includes a pump cylinder or "bushing" and a pump plunger reciprocable in the bushing. Such a "plunger and bushing" ("p&b") assembly defines a pump chamber open at one end for the discharge of fuel during a pump stroke and for fuel intake during a suction or fill stroke of the plunger. The injection nozzle is associated with a valve body having a spray outlet at one end for the discharge of fuel at the nozzle tip. The injection valve is movable in the valve body between open and closed positions to control flow from the spray outlet. The injection valve is spring-biased to a closed position and openable when such discharge of fuel during a pump stroke reaches a given high pressure. The injection valve then remains open until pressure drops to a closing pressure somewhat below the opening pressure. The closing pressure is below the opening pressure because the injection valve face area subject to injection pressures is somewhat greater when the injection valve is open and unseated than when it is closed and seated.

Fuel is supplied to the pump and excess fuel is returned from the pump to a reservoir through low pressure passages communicating with the pump chamber. The low pressure passages constitute spill passages for spilling the fuel discharged by the pump stroke of the plunger. The spill passages intersect the bushing bore at spill ports. The flow areas of the spill ports are each large enough that the fuel is spilled back into the low pressure supply system at a rate high enough to prevent the discharge of fuel, resulting from the pump stroke, from reaching the given pressure at which the injection valve opens to commence fuel injection, or from remaining above the somewhat lower given pressure at which the open injection valve closes.

The length of the injection portion of the pump stroke is adjustable by suitable means including a port-closing edge and a port-opening edge each associated with its own one of a pair of ports opening into the plunger-receiving bore of the bushing. The port-closing and port-opening edges may also be referred to as land edges or as control edges. The port-closing and port-opening edges have different helix angles whereby the interval between port closing (of one port of the pair) and port opening (of the other port of the pair) in each pumping stroke is increased as the angular position of the plunger and the two edges around the axis of the plunger is adjusted throughout a range of adjustment to increase the injection portion of the pump stroke throughout a corresponding range of engine loads. One of the two edges may have a helix angle of zero.

Fuel injection, that is, delivery of fuel to the injection nozzle downstream of the plunger chamber at a high enough pressure to cause the injection valve to open and to remain open, occurs during that part of each stroke of the pump plunger during which both the ports associated with the pair of port control edges are closed or covered by their associated control edges to thereby establish, between the closing of one port and the opening of the other, the fuel delivery effective stroke, i.e., the injection portion of the pump stroke.

The initial rate of fuel injection has a profound influence on the maximum combustion pressure and temperature generated in diesel engine combustion chambers during engine operation. When combustion pressure and temperature are elevated above certain limits, nitrogen is oxidized to form nitrous oxide. Ignition delay is the principal reason for the high pressure and temperature generated. Improved ignition quality of fuel and higher compression pressures can reduce the ignition delay period, but there is a limit to the improvement that can be achieved with improved fuel quality which also carries a cost penalty. Higher compression pressures also have the adverse effect of increasing maximum combustion pressure which in turn tends to increase the formation of nitrous oxide.

BRIEF DESCRIPTION OF THE INVENTION

The present invention contemplates controlling maximum combustion pressure and temperature in a more appropriate and cost effective way by delivering injected fuel at a lower rate during the early part of the injection portion of the pump stroke corresponding to the ignition delay period. Importantly, this is done in such a way that, although the feed rate is reduced, the initial injection pressure is maintained at a relatively high level, preferably at a level which is undiminished from that of a system having no provision for lowering the feed rate during the early part of the injection portion of the pump stroke. This accomplishment of "high-pressure" injection during low-feed-rate initial injection as well as during the final part of injection may be referred to as high-pressure dual-feed-rate injection.

The present invention accomplishes fuel injection at a reduced rate early in the injection process by use of an auxiliary or secondary spill through an auxiliary spill port, but at little or preferably no sacrifice of initial injection pressure. That is, even though a secondary spill is provided, secondary spilling occurs in such a manner that injection pressure is high at the initiation of injection, preferably as high as it would be without secondary spilling. At the same time, the secondary spill is effective to divert part of the pressurized pump discharge, thereby reducing the average rate of delivery of fuel flowing past the injection valve and into the engine chamber in the early part of the injection cycle. The invention utilizes the inherent ruggedness and simplicity of a sleeveless plunger and bushing construction to provide on a practical basis a precise mechanical valving control which accomplishes high-pressure dual-feed-rate injection. The comparative ruggedness and simplicity of the sleeveless valving mechanism makes it possible, with proper porting or spilling action (lacking in prior-art sleeveless devices), to achieve reduced initial feed rate without reducing initial injection pressure, or reducing it only slightly.

In sleeved devices, such is not practical because they are actuated by cams that have lifts that are approximately half, or less, of the lifts of cams that operate the sleeveless devices. The reduced total stroke puts severe limits on the ability of the sleeved devices to provide the normal pump functions such as (1) fill—the initial portion of the plunger stroke (during which both of the ports into the bushing bore are open) required to fill the pumping chamber at high speed, (2) effective stroke—that portion of the cam lift (plunger movement) required to deliver the full-load fuel quantity, and (3) the deceleration portion of the cam lift—that portion of the plunger stroke required to decelerate the reciprocating parts of the follower mechanism to zero at the top of the plunger stroke at high speed.

As just stated, the sleeved design has only about half or less of the plunger stroke (cam lift) of the sleeveless design, and is thereby limited in its ability to perform normal pump functions. Therefore, the sleeved design is unsuitable to the provision of any additional function that requires use of a significant portion of the cam lift, such as the provision of pilot injection characteristics as contemplated by the present invention. Furthermore, sleeved design pumps are used only in high-speed engines. They cannot be use in high-output medium-speed engines for the reasons mentioned above and also because extremely long connecting tubings would be required.

In the past, it has been attempted to deliver fuel at an initially reduced rate by using a two-stage lift cam whereby the initial portion of the cam lift is limited to produce a fixed quantity of fuel delivery by the plunger and then the cam lift ceases for a small period, or slows down, and then resumes its lift at the normal rapid rate to complete the plunger stroke. This two-stage lift method has not been successful because the initial pressure wave generated at port closing is a function of engine speed and injection is inconsistent in the low and intermediate engine speed ranges.

Another previous method has used a separate small plunger to inject a small pilot quantity of fuel preceding the delivery by the main plunger of the main quantity of fuel required by the engine to develop the power required. This is a mechanically complicated and relatively costly system and has not been successful.

It has also been known in the prior art to provide auxiliary porting for a reduced rate of fuel feed in the early part of the injection portion of the plunger stroke, but such arrangements were intended to minimize initial injection pressure and are not believed to have been successful. An example of this is seen in U.S. Pat. No. 2,513,883 to J. F. Male.

It has also been known to use auxiliary porting arrangements effective at varying proportions of the injection portion of the feed stroke, as for example in U.S. Pat. No. 4,741,314 to Hofer in which auxiliary porting is arranged so there is a declining duration of leakage as the engine load increases in a straight line relationship with load such that maximum duration of leakage is at idle and there is zero duration of leakage at full load.

It is also known to use a throttling orifice in the port associated with the port-closing edge of a p&b assembly, purportedly to increase "preliminary pressure" of injection, as in USSR author's certificate 1375848 to Yarosl (see port 2 associated with the edge 6). This throttling within the port 2 applies even before the port begins to be closed by the edge 6 and also applies during the return or fill stroke of the plunger, reducing filling efficiency of the pump. Yarosl does not employ an auxiliary spill port as taught by the present invention.

The invention will be more readily and fully understood from the following detailed description and the accompanying drawings.

BRIEF DESCRIPTION OF THE DRAWINGS

FIG. 1 is a fragmentary cross-section of a prior art unit injector illustrating one environment in which the invention may be employed; the pump plunger of the illustrated injector is shown at full retraction and at the adjusted angular position where there will be no injection during the pump stroke.

FIG. 2 is a diagrammatic illustration of the pump bushing and plunger of the prior art injector of FIG. 1, the view of the pump bushing or cylinder being a cross-section taken from line 2—2 in FIG. 1, and the plunger being removed from the bushing but having the same lengthwise position (full retraction) and the same rotative position (but now viewed from a new perspective) relative to the bushing as it does in FIG. 1, such rotative position being that at which there will be no injection during the pump stroke.

FIG. 3 is a view similar to a portion of FIG. 1 but showing a modification of the illustrated unit injector to incorporate the invention, and again showing the plunger at its full retraction position and at the adjusted angular position where there will be no injection.

FIG. 4 is a diagrammatic view similar to FIG. 2 but including modifications incorporating the invention; the same full retraction position is shown as in FIG. 2; and the plunger is shown at the same adjusted angular position where there will be no injection during the pump stroke.

FIG. 5 also diagrams the manner in which the fuel delivery effective stroke (injection portion of the pump stroke) varies with different angular positions of the plunger.

FIG. 6 shows the plunger at the angular adjustment corresponding to full load (maximum fuel delivery effective stroke).

FIG. 6A is a view showing a plunger similar to that of FIG. 6 but with a spill groove of varying depth.

FIG. 6B is a section on an enlarged scale taken on line 6B—6B in FIG. 6A.

FIGS. 10–12 plot plunger travel against, respectively, percent fuel spill, orifice areas, and fuel delivery per unit of plunger travel. FIG. 13 plots simulated durations of injection (in crank degrees) against rate of injection.

FIGS. 17–19 are three sectional views showing three modifications of a pump cylinder or bushing of a type used in three-piece (pump, tubing, injection assembly) injection systems, to accommodate such pump cylinder or bushing to practice of the present invention.

FIG. 20 is more concrete or less diagrammatic than FIG. 14, and further differs in that in FIG. 20 pilot injection is separated from main injection. As in FIG. 14, the plunger is pointed upward, rather than downward as in the other drawings of p&b assemblies or parts thereof.

FIG. 22 illustrates a p&b design similar to that shown in FIGS. 15 and 16; FIG. 22 is more concrete or less diagrammatic than FIGS. 15 and 16 and also differs in that the ports associated with the port-closing and port-opening edges are at the same longitudinal location on the bushing.

FIG. 22A is a section taken from line A—A in FIG. 22.

DETAILED DESCRIPTION OF THE INVENTION

Figures 5, 6, 7:
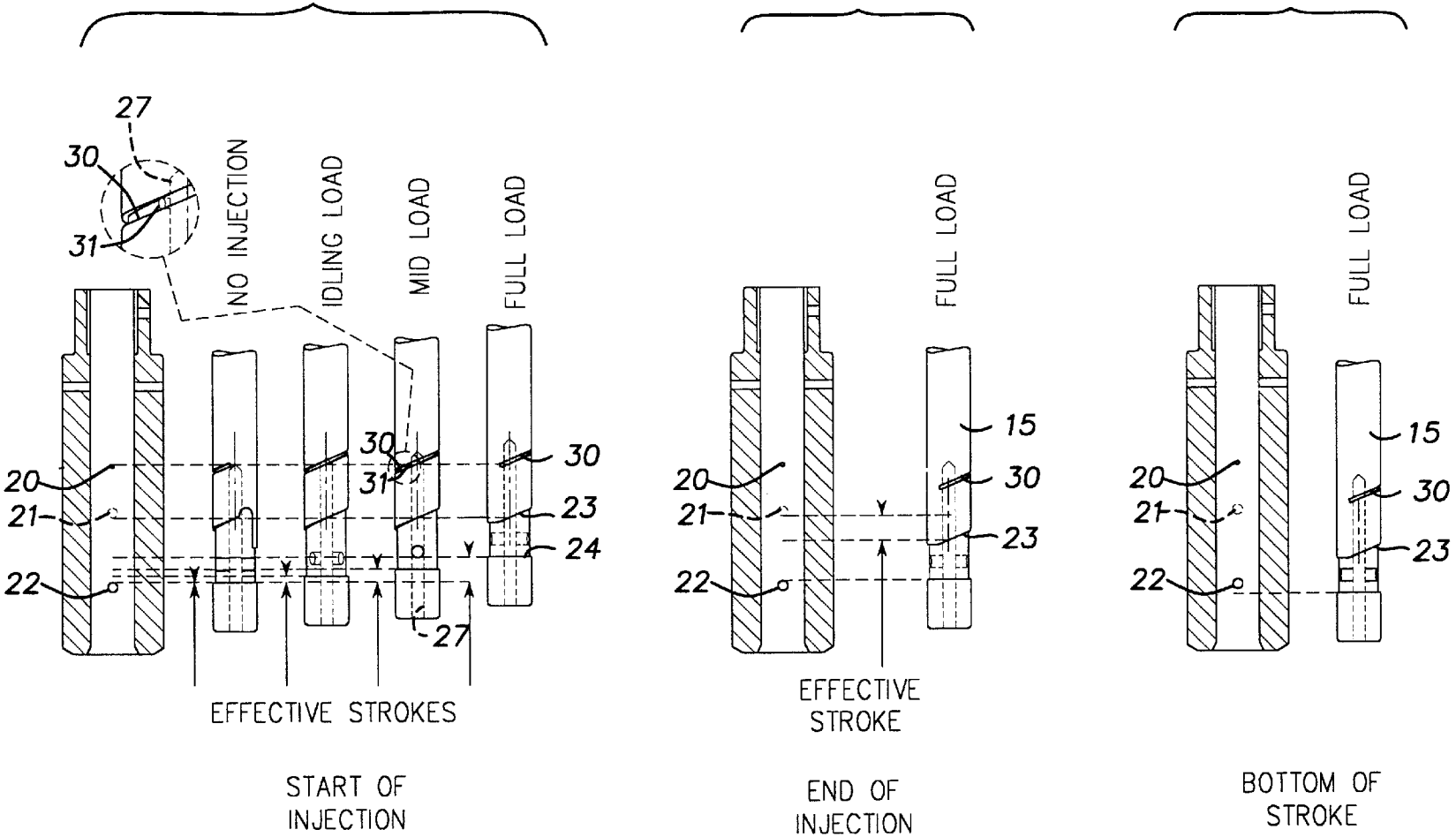
FIG. 5 is a view of the same plunger as shown in FIG. 4, but showing it at the start of injection. Since start of injection occurs at different lengthwise positions of the plunger relative to the ports, depending on the angular adjustment of the plunger, four illustrations of the plunger are included to show the plunger lengthwise position at start of injection for each of four adjustments, namely at no injection, at idling load, at mid load and at full load.
FIG. 6 is a view similar to FIG. 4 but showing the lengthwise position of the plunger relative to the ports at the end of injection.
FIG. 7 is a view similar to FIG. 6 but showing the lengthwise position of the plunger relative to the pump cylinder at the full advance position of the plunger stroke.

In order that the environment in which the invention may be employed may be most readily understood by the reader, whether familiar with the art or not, a simplified conventional diesel locomotive unit injector of a well-known type will first be described in some detail. Such a device is shown in cross-section in FIG. 1, and is generally indicated by the reference numeral 10'.

The housing-nut 11' of the prior-art nozzle 10' is threaded to and is an extension of the main housing (not shown) for the pump-injection unit. The nut 11' extends from the main housing, which is at the exterior of the engine, through a well in the engine cylinder head into the combustion chamber and is clamped in the engine cylinder head in a well known manner. The housing-nut houses the stacked main injector components described below and threadedly clamps them in their stacked relationship in a well known manner.

The injector has a pump cylinder or bushing 14' and a plunger 15' which define together a pump chamber 16' open at one end for the discharge of fuel during each pump stroke and intake of fuel during each suction stroke. The plunger and bushing include spill means in the form of ports 21' and 22' in the bushing and control edges 23' and 24' on the plunger. The port 21' leads from a low-pressure fuel supply (not shown), and the port 22' is connected to a low-pressure fuel return system (not shown). The edges 23' and 24' form a relief or recess 25' in the plunger exterior, and such recess communicates through a cross-hole 26 with a bore 27' which forms a hollow interior of the plunger. The bore opens through the lower face of the plunger, so that the recess 25' and the pump chamber 16' are in fluid communication. (A port such as the port 21' is commonly referred to as an "inlet port" because it acts as the principal inlet when incoming fuel is sucked through it into the recess 25' and hence into the pump chamber 16' during the return or fuel-intake stroke of the plunger. However, in the present disclosure the port 21', and other similar ports will be generally referred to as spill ports, since that is their principal function during the advance stroke of their associated pump plunger.)

The nozzle has an injection valve 18' with differentially sized guide and seat so that there is a fixed relationship between the valve opening pressure and the valve closing pressure. During the pump stroke, until the port-closing edge 23' of the plunger covers the port 21', high pressure cannot be generated because fuel is free to escape back through the port 21' to the low-pressure fuel supply system. Similarly, after the port-opening edge 24' of the plunger uncovers the port 22', high pressure cannot continue to be generated because fuel is free to escape through the port 22' to the low-pressure fuel system. However, during such time as both ports are blocked during the pump stroke, high-pressures within the pump chamber may be generated. Upon closing of the port 21, a high-pressure wave is generated which travels past a check valve 28' and through appropriate ducting into the cavity 32' where the pressure wave acts on the conical differential area 19' of the injection valve 18' to lift the valve off its seat against the force of the spring 29' to begin injection.

The valve stays lifted during the time fuel is being delivered at a pressure higher than the closing pressure of the injection nozzle. When the control edge 24' uncovers the port 22', the pressure in pump chamber 16' drops to fuel return pressure and the check valve 28' seats, sealing the fuel transport duct leading to it from the pump chamber 16'. At the same time, the pressure in the nozzle fuel chamber 32' drops rapidly to below the valve closing pressure, the valve closes and injection ends.

The portion of the pump stroke from the closing of the port 21 to the opening of the port 22 may be referred to as the injection portion of the pump stroke or the fuel delivery effective stroke.

In a well known manner, the angular position of the plunger 15' is changed by a control rack (not shown) to control the amount of fuel delivered with each stroke of the plunger 15' by varying the positions in the stroke at which the ports 21' and 22' are respectively closed and opened. For this purpose, one or both of the edges 23' is formed as a helix having a helix angle other than zero. For simplicity, only the edge 23' is shown as a helix having a helix angle other than zero, and the edge 24' is shown as perfectly "flat", representing a helix angle of zero, thus enabling most ready illustration of the control of fuel delivery by change in angular position of the plunger. In any event, the helix angles of the two control edges differ, so that the interval between port closing and port opening is increased as positions of the two edges around the axis of the plunger are adjusted throughout a range of adjustment to increase the injection portion of the pump stroke throughout a corresponding range of engine loads.

As indicated above, in FIGS. 1 and 2 the plunger 15' is shown at full retraction and at the adjusted angular position where there will be no injection during the pump stroke, that is, the port 22' starts opening as soon as the port 21' closes.

EMBODIMENTS OF THE INVENTION

An injector 10 embodying the invention is shown in FIGS. 3–8. Similarly to the prior art plunger in FIGS. 1 and 2, the plunger 15 in FIGS. 3 and 4 is shown at the top of its stroke and at the adjusted angular position where the ports 21 and 22 are fully open and the adjusted angular position of the plunger is such that there will be no injection during the pump stroke. In the injector 10 of the invention, a supplemental spill port 20 and additional elements comprising one form of supplemental or secondary spill valving means as contemplated by the present invention are provided, as described below. However, apart from the provision of a supplemental or secondary spill in the novel manner contemplated by the invention, the basic system for controlling injection under various load conditions is common to the invention and the prior art and can be readily understood from illustrations of the interrelationships between the basic elements of that control system in FIGS. 3–8. As the angular position of the plunger 15 is adjusted by a conventional rack-and-pinion arrangement (not shown), the distance between the control edges 23 and 24 is decreased with increasing load, so that the upper port 21 closes earlier and earlier in the stroke to thereby increasingly advance the start of injection and increase the amount of fuel delivered each stroke.

According to the present invention, provision is made for secondary spilling of fuel during a secondary spill period at the early part of the injection portion of the pump stroke, but in such a way that there is little or no reduction of initial injection pressure as compared to a like system without secondary spilling. In the embodiment illustrated in FIGS. 3–8, this involves providing a secondary or supplemental spill orifice or port 20 in the bore of the pump cylinder, and a cooperating spill groove 30 formed in the plunger 15. The spill groove 30 is connected to the extended central bore 27 via a passage or hole 31 (visible only in the angular position of the plunger corresponding to mid-load as seen in FIG. 5) and therefore is connected indirectly via the bore 27 to the pump chamber 16. The interaction between the port 20 and the groove 30 is such that, when they are in register, they define a secondary spill aperture for spilling fluid from the pump chamber back to the low pressure fuel return system.

Side thrust on the plunger produced by high pressures occurring in the groove 30 may be counterbalanced by a shallow cutout or dummy port (not shown), of circular or other shape, formed in the side of the plunger 15 and centered opposite the center of the groove 30. Such cutout may be ported to the central bore 27. This cutout is of such diameter or other dimension or dimensions that pressurized fuel therein provides an exact or approximate counterbalancing force which acts against and neutralizes the side thrust imposed by pressurized fuel in groove 30. Such a balancing arrangement, if needed, may be employed in any of the various embodiments described herein.

The bottom edge of the spill groove 30 is at the same helix angle as the edge 23, and the top edge may also be at this same angle, as shown. The relationship of the parts is preferably such that the following applies throughout a range of engine loads: as the plunger moves downward and the edge 23 completes closing of the port 21 to initiate the injection portion of the pump stroke, the lower edge of the spill groove 30 just begins to open the auxiliary spill port 20, as seen in the development in FIG. 8 for the range of engine loads which includes the full load, mid-load and idle positions and all points in between. Or, the spill groove 30 may be shaped or truncated so that the range of engine loads where this relationship holds is more or less than that shown, and may for example not include the idle load. In general, whatever the bottom limit of this range, its upper limit will extend to the full power setting.

As the lower edge of the spill groove 30 begins to open the spill port 20, the above-mentioned secondary spill aperture is created. As the parts continue their relative movement, this aperture increases in size to a maximum and then decreases to zero as the trailing edge of the spill groove 30 moves over the port 20 to start occluding it.

Figure 8:
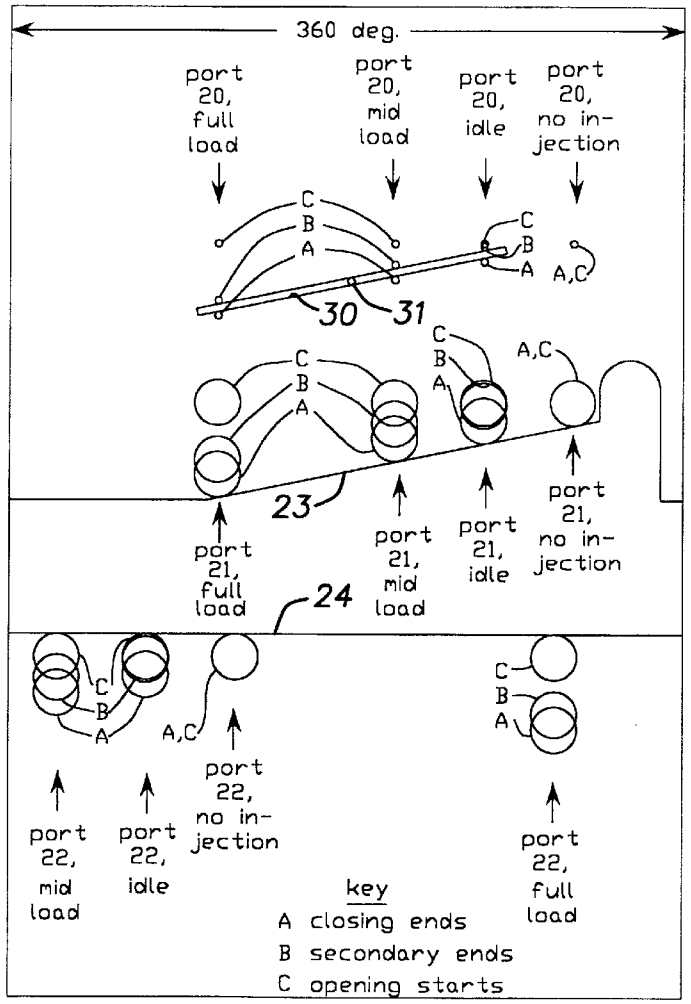
FIG. 8 is a development view or diagram of the apparatus of FIGS. 3–7 showing the relationship between the ports of the bushing and the port-closing and port-opening edges of the pump plunger, showing their interrelationship throughout 360 degrees of plunger development and relative angular position of the bushing ports throughout the range of relative axial movement between the bushing ports and the closing and opening edges of the pump cylinder ports and the plunger lands.

Alternatively, the parts may be arranged (for example, the spill groove 30 may be shifted very slightly upward from where it is shown in FIG. 8) so that there is a very brief interval between the completion of the closing of the port 21 and the beginning of the opening of the port 20 throughout one of such described ranges of engine loads. This delay of the beginning of opening of the port 20 following completion of the closing of the port 21 is preferably less than 5 percent of the fuel delivery effective stroke of the plunger at full load. That is, the delay, measured in distance of plunger movement, is preferably less than 5 percent of the maximum fuel delivery effective stroke of the plunger. More preferably, the delay is less than 3 percent of the maximum fuel delivery effective stroke, and still more preferably less than 2 percent. Limiting such delay is desireable to avoid injecting too much fuel during the ignition delay period of the engine.

Under both the alternatives just described, the secondary spill period is wholly within the early part of the injection portion of the pump stroke, and the beginning of the injection portion of the pump stroke is characterized by fuel injection pressures undiminished from what they would be without secondary spilling. Moreover, these pressures are followed up by almost the full pressure delivery of the plunger because the secondary spill aperture is initially small and increases only as plunger travel further progresses.

In the real-world context of the present invention, the concept of simultaneity—the starting of opening of the auxiliary spill port 20 just as the port 21 completes its closing—is a somewhat idealized concept in terms of actual tolerances that are practically achievable. Therefore in this disclosure and in the claims, references to simultaneity, to coincidence, or to one port starting to open "just as" the other completes closing, and like references mean a relation between the parts, and operation of the parts, such that under all tolerance conditions the auxiliary spill port starts to open exactly when the plunger port closes or just before port closing only to the extent of the total combined involved tolerances. Stated another way, references to simultaneity, or to coincidence, or to one port starting to open "just as" the other completes closing, mean, for example, that the opening of auxiliary spill port 20 occurs exactly when closing of port 21 occurs or before port closing only to the extent of the total combined tolerances of the auxiliary spill port 20 location relative to the location of the port 21, spill port hole size tolerance, location of the spill groove 30's opening edge relative to the port-closing control edge 23, and location of the port-closing control edge 23 relative to its manufacturing reference point.

Another presently less preferred alternative is to arrange the parts (for example, the spill groove 30 may be shifted very slightly downward from where it is shown in FIG. 8) so that the secondary spill aperture begins to open before the port 21 is fully closed, but so soon before that when the port 20 fully closes, the secondary spill aperture has reached not more than 20 percent of its maximum value, and preferably not more than 10 percent of its maximum value, and still more preferably not more than 5 percent of its maximum value. Under these circumstances, the beginning of the injection portion of the pump stroke is still characterized by the normally experienced relatively high injection pressures.

In broader aspects of the invention, one or another of the above alternatives may apply at different parts of one of such above-mentioned ranges of engine loads, or more preferably one or the other of the first two of such alternatives may apply at different parts of one of such ranges.

In all such alternatives, the average fuel feed rate past the injection valve during the early part of the injection portion of the pump stroke is reduced from what it would have been without secondary spilling, but undiminished or relatively high initial injection pressure is also accomplished to provide an injector capable of practical and efficient operation.

One principal application of the invention is use in diesel locomotive engines. Such engines typically drive electric generators which in turn supply power to tractor motors which turn the locomotive wheels. This lack of direct mechanical drive between engine and wheels allows the engine to operate in an essentially steady state mode in a number of different power settings or notches. Current locomotives have eight power notches and an idle setting. At each notch setting the engine is governed at a different speed, ranging from maximum at full load to a minimum at idle.

Injectors designed for use on locomotive engines or in other applications where engine speed decreases as engine load decreases, in their preferred form, employ an auxiliary spill groove on the plunger having a variable depth, with maximum depth at the full load position and minimum at the no load (idle) setting. Thus, the embodiment illustrated in FIGS. 3–8 may be modified in the manner shown in FIGS. 6A and 6B by providing a plunger 15*b* having a spill groove 30*b* that varies in depth in the manner described. For injectors operating a variable speeds, if the spill groove on the plunger had a fixed depth over its entire length such that the bypass leakage path area is the same at high speed (full load) as it is at low speed (low load), there would be greater bypass leakage at low speed because the time for the spill groove to travel over the auxiliary spill port in the bushing is greater as the engine speed decreases; this is so even though the plunger travel is the same in engine cam degrees. This increased bypass leakage through the auxiliary spill port would result in the reduced initial rate portion (pilot portion) of the injection being reduced to zero at some intermediate speed (load).

Therefore, the depth of the spill groove on the plunger is made to that level at which the full bypass leakage quantity is made the same at each notch (speed) position.

Figure 9:
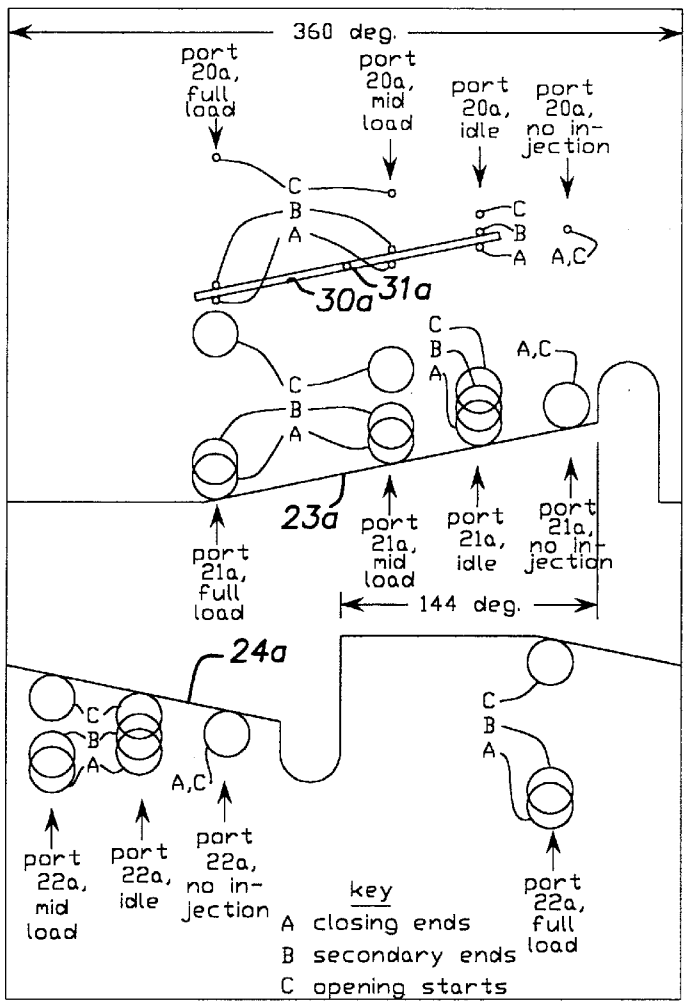
FIG. 9 is a development view similar to FIG. 8, but showing a plunger and bushing arrangement with both port-closing and port-opening control edges having non-zero helix angles, equal in magnitude but opposite in sign. This arrangement substantially doubles the amount of adjustment of displacement per unit of angular adjustment, and thereby is more practical in many applications; however the context of the present invention is perhaps most easily explained and understood by first referring to the simpler constructions of the earlier illustrations.

As previously indicated, and as illustrated in FIG. 9 by the land edges 23*a* and 24*a*, in actual applications of the invention, both of the land edges may have a helix angle other than zero and the edges may be of opposite hand or slope, so that as the angular position of the plunger is adjusted for increasing load, the upper port closes earlier and earlier in the stroke to thereby increasingly advance the start of injection, and the lower port opens later and later to thereby increasingly delay the end of injection, thereby achieving about double the degree of adjustment of fuel delivery that can be achieved when only one of the two control edges has the same given degree of helix angle and the other has a zero degree helix angle. The remaining elements in FIG. 9 generally correspond to the like-numbered elements in FIG. 8 but with the addition of the letter "a".

In the illustrations, the spill ports 20 and 20*a* are shown as circular and the spill grooves 30 and 30*a* are shown as having each of their sides formed at the same helix angle and each of their ends bluntly truncated. Other variants are possible. Openings of other shapes which slidably register with each other in a similar manner may be employed to the same effect, for example the port or orifice 20 may be square or rectangular, with two of the four sides parallel to the sides of the groove 30, and this may be preferred so that the secondary spill aperture increases to its maximum value (and subsequently decreases to zero) almost instantaneously. The rectangular shape also enables significant reduction in crank degrees for a given duration of the reduced rate of injection phase. An elliptical groove may have similar advantages. The shape of the orifice may be triangular, with the base of the triangle lowermost, as viewed in a view corresponding to FIG. 9, and parallel to the lower edge of the spill groove 30, so that the secondary spill aperture increases toward its maximum value more slowly than the illustrated apparatus does. The upper side of the spill groove 30 may have a slightly different helix angle than the lower side so that it becomes increasingly wide or narrow in one direction or the other or toward one groove end or the other, and secondary spilling occupies a greater or lesser portion of the plunger stroke as power settings are changed. In general, the choice of alternatives discussed above may be at least in part governed by the shape of initial fuel injection desired. The reduction of the injection rate during the early part of the injection portion of the pump stroke is governed by such factors as the size of the spill port 20 and the width of the spill groove 30.

For purposes of analysis and discussion, assume that in operation the rate of fuel injected through the nozzle orifices and spilled through the secondary spill port 20 are exactly equal to the rate of fuel delivered by the plunger 15. For the case when secondary spill port 20 starts to open at the same time that port 21 completes closing, neglecting the time for the pressure wave to travel from the plunger to the injector nozzle, the quantity of fuel injected through the nozzle orifices is equal to the rate of fuel delivered by the plunger, because the injection orifices are totally open when the nozzle valve lifts and the spill port 20 is covered, and is only just beginning to open. As the plunger continues to travel, at each point of travel the fuel spilled is a function of the then-obtaining ratio of (i), the area of the secondary spill aperture to (ii) the combined area of the total orifice area of the nozzle and the area of the secondary spill aperture. The quantity of fuel spilled during plunger travel increases to the point of maximum opening of the secondary spill aperture after which it decreases at the same rate it increased depending on plunger velocity until it reaches zero.

Figure 11:
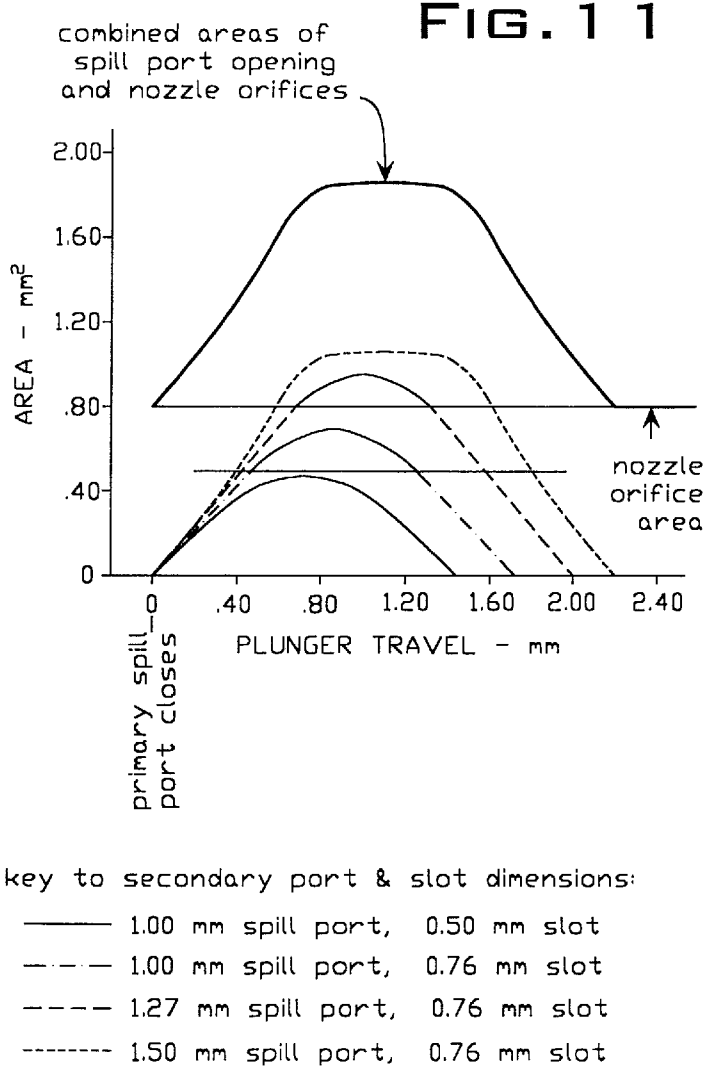
FIGS. 10–13 are hypothetical graphs illustrating the operation of the invention.
Figure 10:
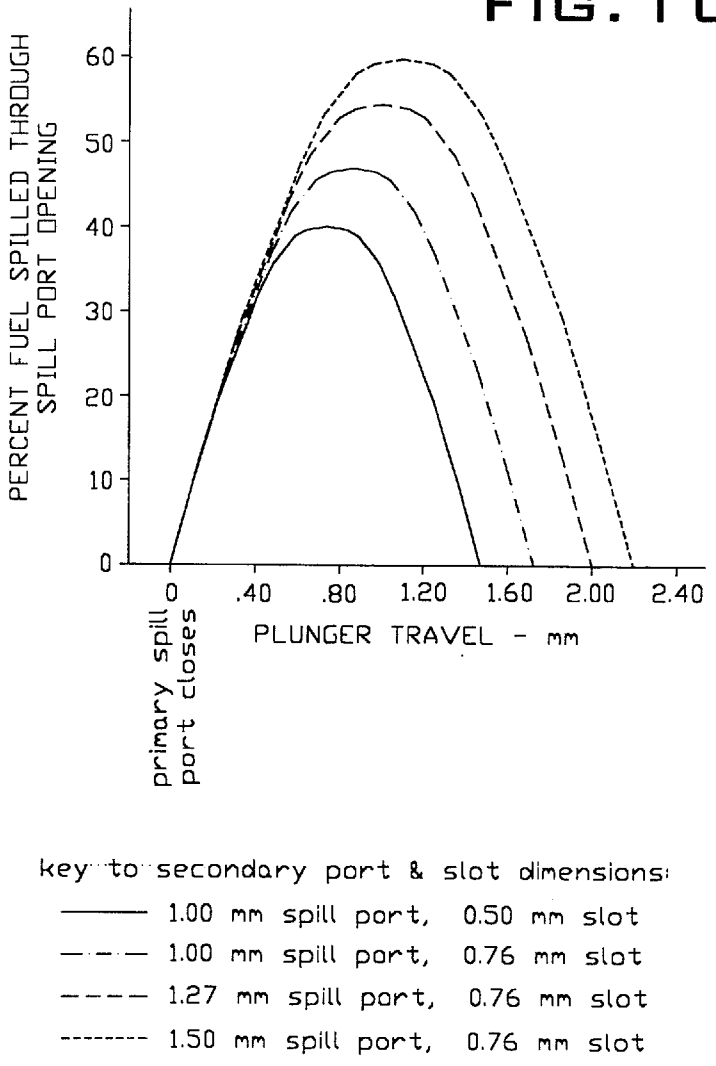

FIGS. 10 and 11 illustrate this hypothetically. The larger the spill port 20, the greater the quantity of fuel that will be spilled and the longer the duration of spill. Also the wider the spill groove 30, the greater the quantity of fuel that will be spilled and the longer the duration of spill.

Figure 12:
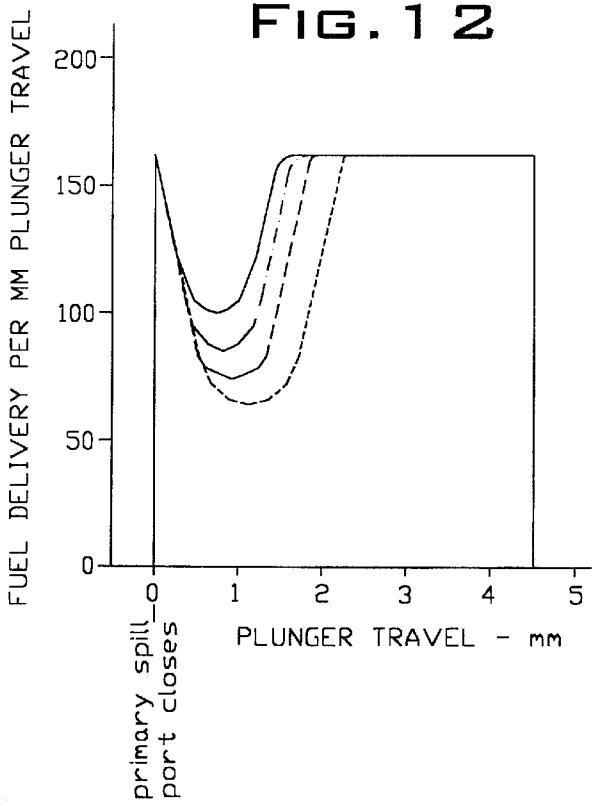

FIG. 12 shows a hypothetical example of the interrelationship of secondary spill port size and spill groove width on how they affect the geometric rate of injection for the case when secondary port 20 starts to open at the same time that port 21 completes closing. The effects of three spill secondary port sizes and two groove widths on the geometric rate for the conditions specified above are shown. Note again that the larger the secondary spill port and/or spill groove, the lower the initial rate of injection and the longer the duration for the reduced rate. By using a secondary spill port shaped differently from a round hole, such as triangular, square or rectangular, the area of the spill port opening can affect appreciably the shape of the initial injection rate. Therefore, it is possible by this means to optimize the shape of the initial rate of injection curve.

Figure 13:
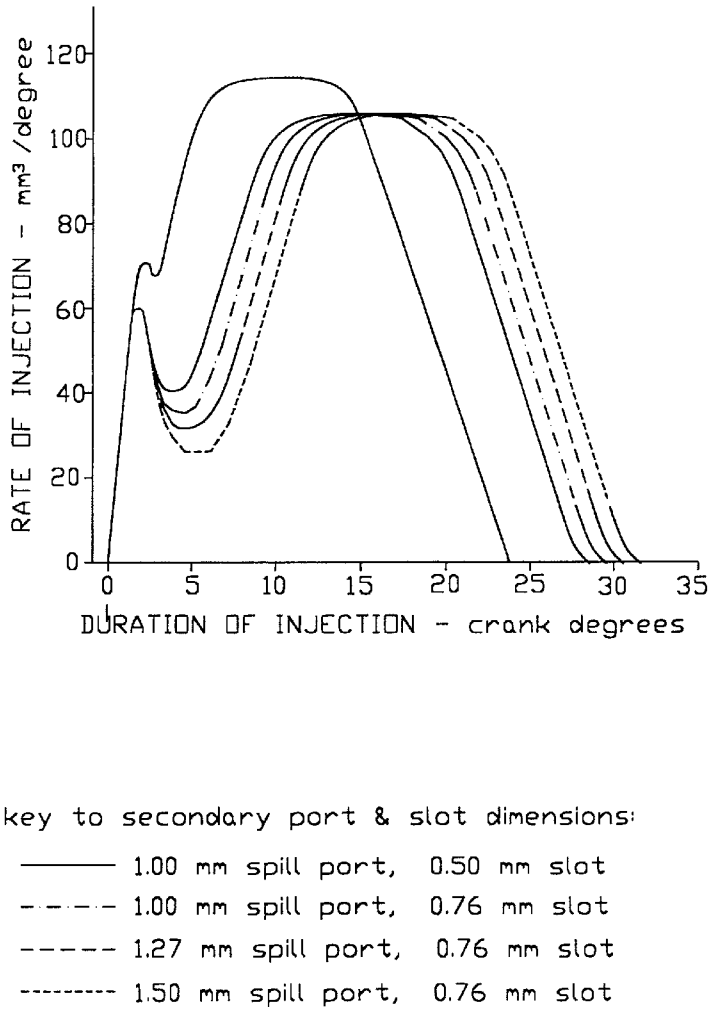

Because fuel is spilled, to maintain the same full load fuel delivery quantity using the same plunger size, the total duration of injection will increase as hypothetically shown in FIG. 13. If optimum combustion efficiency dictates a shorter total duration of injection, equal to that without the reduced initial rate, a larger plunger size can be used. Another way to make up the fuel spilled through the secondary spill port is to move the control edge 24*a* as seen in FIG. 9 upward above its illustrated position by an amount such that the distance between the illustrated and the new positions represents the plunger displacement equivalent to the fuel spilled through the secondary spill port 20.

FIG. 13 shows a conceptual rate of discharge, a discharge imagined as it might occur. The normal rate of discharge expected with a standard unmodified injector is shown in solid line for comparison with the rate curves that are produced with the spill port and control groove. Note the highly significant reduction in initial rate of injection with the various combinations of spill port size and control groove size. It is accepted universally in the diesel and fuel injection industry that a gradually increasing initial rate of injection helps reduce NOX. Therefore, with increasing federal efforts to reduce exhaust emissions of all types for all diesel engines, the optimization of the initial rate of fuel injection as a practical manner is a most important objective achieved by the present invention.

The curves displayed in FIG. 13 do not represent actual measured performance data and may not show exactly what the actual rate of injection would be in some specific injection system. However, there is no question that the standard unmodified injector produces a very rapid rise in the rate of fuel injection as distinguished from the low rate of rise with the secondary spill port and control groove of the present invention. Again, the rate of fall toward the end of injection may not be exactly as depicted. However, the end of injection must be virtually the same for both unmodified and modified plunger and bushing, because what happens in the early part of injection will not have too much effect on the rate curve after the port 22 is opened by the land edge 24*a*.

Figure 14:
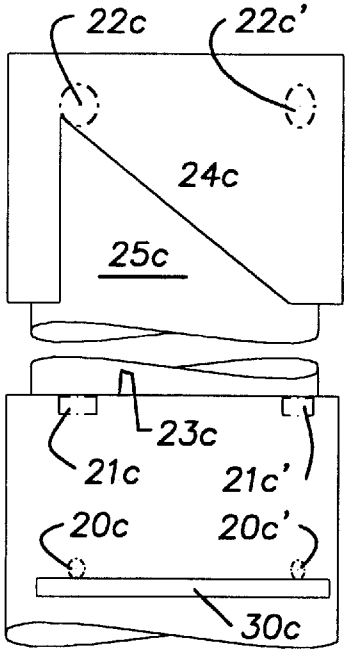

FIG. 14 is a diagrammatic fragmentary showing of another general type of p&b design modified to embody the invention by adding an auxiliary spill sport (port 20*c*) and a cooperating spill groove (groove 30*c*). This general type of p&b design will be recognized by those skilled in the art as a newer EMD (acronym for Electromotive Division, formerly a division of General Motors) design. For simplicity of illustration, the bottom half of FIG. 14 is shown rotated 180 degrees from the top part; in other words, the top and bottom portions of FIG. 14 view the plunger from opposite sides. For further simplicity of illustration, only the spill ports formed in the bushing are shown (in phantom, the spill ports in the illustration being understood to be located on the same side of the plunger as the viewer); the bushing itself is not illustrated; also, the internal ducts in the plunger are not shown. Two positions of each of the spill ports relative to the plunger are shown: the three spill ports are identified by the reference numbers 20*c*, 21*c* and 22*c* in their zero fuel delivery positions; in their full load delivery positions they are identified by the reference numbers 20*c*', 21*c*' and 22*c*'.

In this general type of design, the port-closing edge 23*c* has a helix angle of zero. The port-opening edge 24*c* and the port-closing edge 23*c* define the recess 25*c* which is connected via a central bore (not shown) to the pump chamber above the face or top of the plunger.

The spill groove 30*c* that cooperates with the auxiliary spill port 20*c* is joined via internal ducts (not shown) to the plunger bore (not shown) and therefore to the pump chamber. The operation of this embodiment is similar to, and should be obvious from the foregoing description of, the embodiment of FIG. 3 and related drawings.

Figure 16:
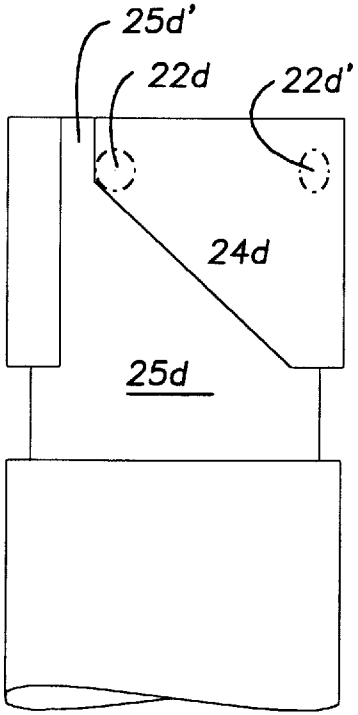
FIGS. 14–16 are diagrammatic fragmentary showings on an enlarged scale of other types of p&b designs modified to embody the invention. The plunger is pointing downwardly, rather than upwardly as in most of the other drawings.
Figure 15:
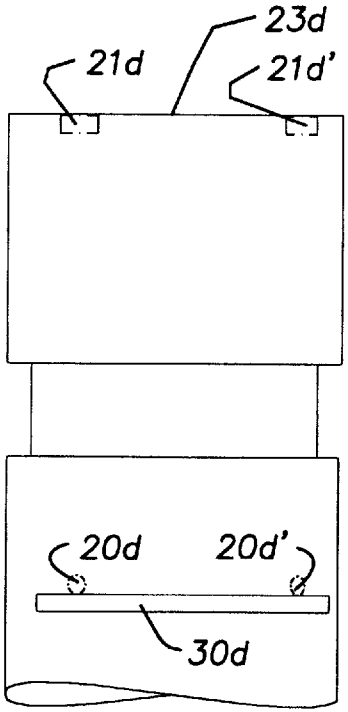

FIGS. 15 and 16 provide a diagrammatic fragmentary illustration of another general type of p&b design modified to embody the invention by the addition of auxiliary spill port 20*d* and cooperating spill groove 30*d*. This general type of p&b design will be recognized by those in the art as a certain General Electric design. FIGS. 15 and 16 view the same plunger from opposite sides. For simplicity of illustration, only the spill ports formed in the bushing are shown (in phantom, the spill ports in the illustration being understood to be located on the same side of the plunger as the viewer); the bushing itself is not illustrated. Two positions of each of the spill ports relative to the plunger are shown: the three spill ports are identified by the reference numbers 20*d*, 21*d* and 22*d* in their zero fuel delivery positions; in their full load delivery positions they are identified by the reference numbers 20*d*', 21*d*' and 22*d*'.

In this general type of design, the port-closing edge 23*d* has a helix angle of zero and constitutes the edge of the face of the plunger. The plunger recess 25*d* is connected to the pump chamber above the face of the plunger via the exterior groove 25*d*'.

The spill groove 30*d* is joined via internal ducts (not shown) to the pump chamber. The operation of this embodiment is similar to the operation of previously described embodiments, and should be obvious from such previous descriptions.

The embodiments of the invention described above have generally related to unit injectors. The features of the invention can be utilized in any plunger and bushing pump assembly used in fuel injection systems, for example in a three-piece type injection system consisting of pump, tubing and injection assembly.

FIGS. 17–19 show typical ways in which a pump cylinder or bushing 14*e* of such a system could be drilled and plugged to provide a secondary spill orifice or port 20*e*. This port would be related to the primary ports 21*e* and 22*e* and to port-closing and port-opening edges on the pump plunger (not shown) in the general manner disclosed in the unit injection embodiments described above. For simplicity of illustration, in FIGS. 17–19, the port 20*e* is shown 90 degrees removed from each of the ports 21*e* and 22*e*, rather than being aligned with either of them.

Figure 20A:
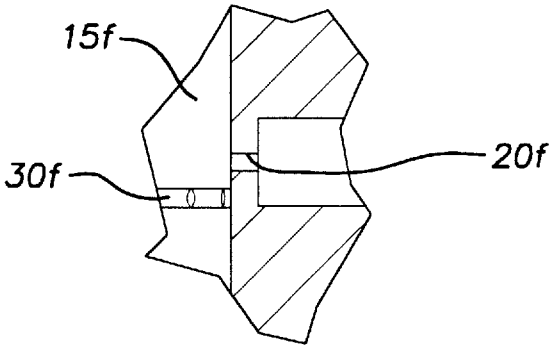
FIG. 20A is a fragmentary view on an enlarged scale of a small portion of FIG. 20.
Figure 20:
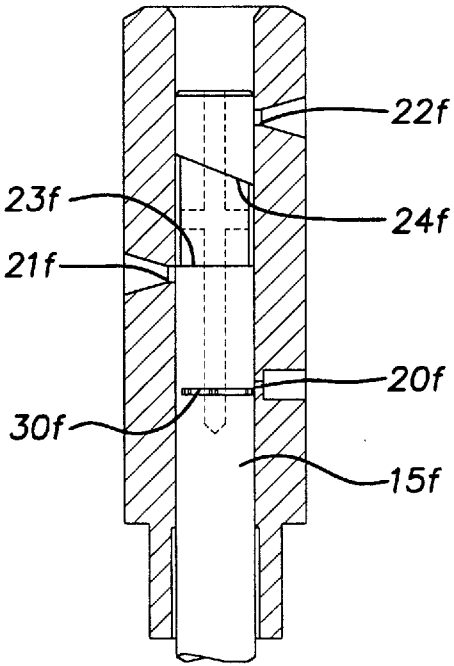
FIG. 20 illustrates a p&b design similar to that shown in FIG. 14.

FIG. 20 is a more concrete view of a p&b assembly similar to that shown in FIG. 14. While the device of FIG. 14 provides pilot injection unseparated from main injection, the device of FIG. 20 provides separate pilot injection. When, as shown, the zero-angle edge 23*f* has just closed the port 21*f*, the groove 30*f* is still spaced a fair distance, say at least its own width, from the closest edge of the auxiliary spill port 20*f*, as best seen in FIG. 20A. The auxiliary spill port remains closed until the plunger advances the amount required to produce the (separate) pilot delivery, at which time the auxiliary spill groove 30*f* opens the auxiliary port 21*f*. Spill through the groove 30*f* and port 20*f* then continues until the trailing side of the groove 30*f* covers the port 20*f* and main injection begins. Thus, the injection portion of the pump stroke (the fuel delivery effective stroke), which extends from the closing of the port 21*f* by the edge 23*f* to the uncovering of the port 22*f* by the edge 24*f*, includes a hiatus between pilot injection and main injection. The groove 30*f* on the plunger is of a constant depth which is deep enough to have sufficient flow area to provide the necessary spill.

Figure 21:
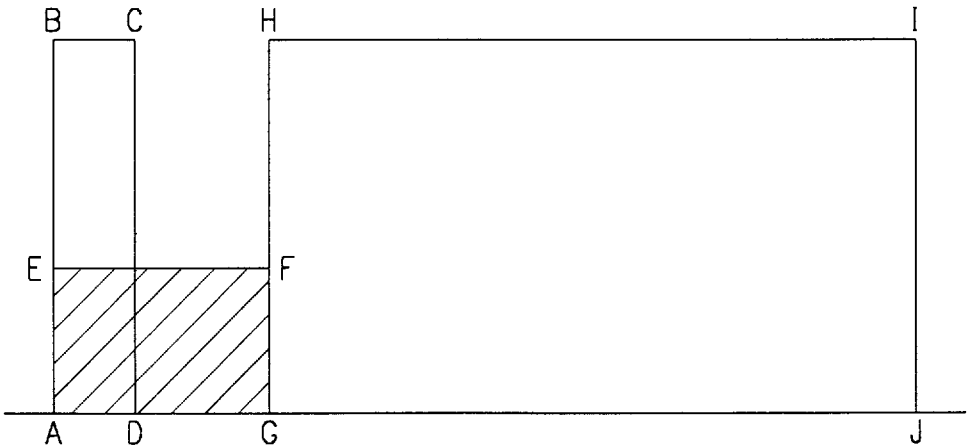
FIG. 21 is a highly abstract diagram comparing separate and non-separate pilot injections.

FIG. 21 diagrams an idealized comparison of separate and non-separate pilot injection at full load. The vertical axis represents fuel delivery per crank degree. The horizontal scale represents duration of injection in crank degrees. The injection portion of the pump stroke extends from point A to point J.

Area ABCD and shaded area AEFG are of the same measure and represent the same fuel displacement, say 7.5 percent of total full load delivery, as shown. Area ABCD represents idealized separate injection at the full rate of delivery as performed say by the apparatus of FIG. 20 with its "wide open" spill groove 30*f* of constant depth; area AEFG represents idealized non-separate injection at a reduced rate as performed say by the apparatus of FIG. 14, whose spill groove 30*c* would be of varying depth.

Assuming an ignition delay period of AG degrees, the same amount of fuel has been delivered into the engine combustion chamber at the end of the ignition delay period no matter whether separate full-rate pilot delivery or reduced-rate non-separate pilot delivery is employed. The average rate of delivery over the initial part of the injection portion of the pump stroke is the same for both, and is lower than it would be without the auxiliary porting. Separate pilot delivery may be preferable in many applications since atomization will be better and initial combustion temperature rise would be more rapid which should enhance burning of the main injection.

FIG. 22 is a more concrete view of an assembly similar to that shown in FIGS. 15 and 16, and includes the auxiliary spill port 20*g*, the spill ports 21*g* and 22*g*, the port-closing edge 23*g* (the face of the plunger), the port-opening edge 24*g*, and the spill groove 30*g*. Since the helix angle of edge 24*g* is relatively steep, less than 180 degrees of rotative adjustment of the plunger is needed to encompass the entire range of adjustments up to full load, and the ports 21*g* and 22*g* can therefore be located at the same longitudinal location on the bushing but removed 180 degrees from each other (i.e., facing each other), as shown.

In the particular set-up shown, the groove 30*g* is positioned to start opening the port 20*g* just as the port 21*g* is closed by the port-closing edge 23*g*, so that in this particular set-up, pilot injection is not separated from main injection, but such could be readily accomplished by changing the relative location of the groove 30*g*. In light of the foregoing descriptions of other embodiments, it is believed that the operation of the plunger of FIG. 22 will be clear to those skilled in the art without further explanation; in particular, details such as the purpose and operation of the illustrated high pressure fuel leakage groove formed in the bushing (no reference number), and the passage for returning such leakage to the inlet for the port 22 (no reference number) have no direct bearing on the invention, will be obvious to those skilled in the art, and require no further discussion.

The spill grooves such as grooves 30, 30*a*, etc. described above generally extend lengthwise substantially throughout a distance corresponding to the operative lengths of their associated port-closing edges and therefore are associated with substantially the entire range of adjustments over all modes from pilot to full load. However, constructions may be provided similar to any of the above-described embodiments but in which the grooves extend only partly along the lengths of their associated port-closing edges. In such a case, the reduced initial flow rate operation as described above will be provided for that part of the range of adjustments that corresponds to the portions of the port-closing edge's length that the spill groove is associated with.

The foregoing improvements offer an eminently practical means to substantially reduce nitrous oxides emissions and combustion noise by modifications of diesel fuel injectors. It should be evident that this disclosure is by way of example, and that various changes may be made by adding, modifying or eliminating features without departing from the fair scope of the teaching contained in this disclosure. The invention therefore is not limited to particular details of this disclosure except to the extent that the following claims are necessarily so limited.

What is claimed is:

1. A diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the injection portion of the pump stroke throughout a corresponding range of engine loads, secondary spill means for providing secondary spilling of fuel from said chamber during a secondary spill period, which overlaps the early part of said injection portion of said pump stroke, said secondary spill means including a secondary spill aperture defined by an interacting pair of openings associated respectively with the bore of said pump bushing and the periphery of said plunger, said opening associated with the periphery of said plunger comprising a groove extending generally at a helix angle, zero or greater, similar to that of said port-closing edge, said groove extending around the periphery of said plunger an angular extent corresponding to the peripheral extent of at least a portion of said port-closing edge, said pair of openings opening to the interface between said plunger and said pump cylinder, said secondary spill aperture performing said secondary spilling such that spilling through said secondary spill aperture is initiated at or shortly after initiation of said injection portion of said pump stroke throughout at least a portion of said range of engine loads, the range through which increases or decreases in engine load are associated with corresponding increases or decreases in said interval, whereby, throughout said at least a portion of said range of engine loads, fuel injection at pressures substantially undiminished from what they would be without said secondary spilling characterizes the beginning of said injection portion of said pump stroke while at the same time the average fuel feed rate past said injection valve during said early part of said injection portion of said pump stroke is reduced from what it would be without said secondary spilling.

2. A device as in claim 1, said secondary spill aperture performing said secondary spilling such that spilling through said second spill aperture, although initiated shortly after initiation of said injection portion of said pump stroke, is initiated sufficiently after and at sufficient spill rates to allow injection to occur, and then be interrupted during secondary spill, and then resume.

3. A device as in claim 1, said secondary spill aperture performing said secondary spilling at limited spill rates such that once injection begins at initiation of said injection portion of said pump stroke, it continues without interruption throughout said injection portion of said pump stroke, although at a diminished fuel feed rate during said secondary spilling.

4. A device as in claim 1, said secondary spill aperture performing said secondary spilling such that the delay, measured in distance of plunger movement, in initiation of spilling through said second spill aperture, following initiation of said injection portion of said pump stroke, is less than 5 percent of the maximum fuel delivery effective stroke of the plunger.

5. A device as in claim 1, said secondary spill aperture performing said secondary spilling such that the delay, measured in distance of plunger movement, in initiation of spilling through said second spill aperture, following initiation of said injection portion of said pump stroke, is less than 3 percent of the maximum fuel delivery effective stroke of the plunger.

6. A device as in claim 1, said secondary spill aperture performing said secondary spilling such that the delay, measured in distance of plunger movement, in initiation of spilling through said second spill aperture, following initiation of said injection portion of said pump stroke, is less than 2 percent of the maximum fuel delivery effective stroke of the plunger.

7. A diesel injector for injecting diesel fuel into an engine chamber in a controlled manner, said injector being of the type including a sleeveless pump comprising a two-piece lengthwise-extending pressure-containing plunger-and-bushing subassembly including a pump bushing and a pump plunger sliding in said bushing, a pump chamber at the distal end of said plunger adapted to contain fuel under low pressure prior to the pump stroke of said pump, said pump plunger being reciprocable in the pump bushing for pressurizing fuel in the pump chamber with a pump stroke having predefined rates of displacement along the stroke length to force a discharge of fuel under pressure, and to force said pressurized fuel from the chamber to open and pass an injection valve during an injection portion of the pump stroke, means for controlling the length of said injection portion of the pump stroke, said means for controlling including a port-closing edge and a port-opening edge associated with ports opening into the plunger-receiving bore of said bushing, said two edges having different helix angles, not excluding a helix angle of zero for one of them, whereby the interval between port closing and port opening in each pumping stroke is increased as the angular position of the plunger and said edges around the axis of the plunger is adjusted throughout a range of adjustment to increase the fuel delivery effective stroke throughout a corresponding range of engine loads, secondary spill means for providing secondary spilling of fuel from said chamber during a secondary spill period, which overlaps the early part of said injection portion of said pump stroke, said secondary spill means including a secondary spill aperture defined by an interacting pair of openings associated respectively with the bore of said pump cylinder and the periphery of said plunger, said opening associated with the periphery of said plunger comprising a groove extending generally at a helix angle, zero or greater, similar to that of said port-closing edge, said groove extending around the periphery of said plunger an angular extent corresponding to the peripheral extent of at least a portion of said port-closing edge, said pair of openings opening to the interface between said plunger and said pump cylinder, said secondary spill aperture performing said secondary spilling such that spilling through said secondary spill aperture is initiated before initiation of said injection portion of said pump stroke throughout at least a portion of said range of engine loads, the range through which increases or decreases in engine load are associated with corresponding increases or decreases in said interval, but so shortly before that, throughout at least a portion of said range of engine loads, when said injection portion of said pump stroke is initiated, the secondary spill aperture has reached not more than 20 percent of its maximum value.

8. A device as in claim 7 in which, when said injection portion of said pump stroke is initiated, the secondary spill aperture has reached not more that 10 percent of its maximum value.

9. A device as in claim 7 in which, when said injection portion of said pump stroke is initiated, the secondary spill aperture has reached not more that 5 percent of its maximum value.

* * * * *